US006648046B1

(12) United States Patent
Gibson

(10) Patent No.: US 6,648,046 B1
(45) Date of Patent: Nov. 18, 2003

(54) ADJUSTABLE BLIND HOLDER

(76) Inventor: William Lee Gibson, 1211 Macdonald Ct., Dacono, CO (US) 80514

( * ) Notice: Subject to any disclaimer, the term of this patent is extended or adjusted under 35 U.S.C. 154(b) by 0 days.

(21) Appl. No.: 10/156,038

(22) Filed: May 28, 2002

(51) Int. Cl.[7] ..... E06B 9/00
(52) U.S. Cl. ..... 160/39; 160/178.1 R; 160/902
(58) Field of Search ..... 160/178.1 R, 902, 160/39, 903, 173 R, 168.1 R, 38, 19; 248/251, 256, 257, 259, 265, 269, 271

(56) References Cited

U.S. PATENT DOCUMENTS 1,576,840 A * 3/1926 Meyer ..... 160/24
1,911,749 A * 5/1933 Chambers ..... 160/38
1,949,653 A * 3/1934 Moore ..... 160/178.1 R
2,787,322 A * 4/1957 Jacobson et al. ..... 160/178.1 R
2,837,152 A * 6/1958 Moore ..... 160/168.1 R
3,372,728 A * 3/1968 Schaefer ..... 160/39
4,699,196 A * 10/1987 Elliott ..... 160/168.1 R
5,143,336 A * 9/1992 McMichael ..... 248/265
5,673,741 A * 10/1997 Cairns ..... 160/39 X
6,192,962 B1 * 2/2001 Glover ..... 160/38 X
6,382,295 B1 * 5/2002 Nicholson ..... 160/178.1 R

* cited by examiner

*Primary Examiner*—David Purol

(57) ABSTRACT

The adjustable blind holder is a single unit that solves multiple problems that are posed in the hanging of various window-covering options. The prior art involves the installation of separate units that act as braces for the head rail of a window covering. This poses the difficulty of mounting the brackets so that the head rail will be level when hung. The adjustable blind holder solves this problem by unifying disparate elements in a unique way that will allow the installation of a single unit that can be leveled easily. Also the elements of the blind holder allow for a versatile decorative cover.

11 Claims, 3 Drawing Sheets

ADJUSTABLE BLIND HOLDER

BACKGROUND OF THE INVENTION

1. Field of the Invention

The present invention relates to an adjustable blind holder for use in connection with the hanging and decorating of blinds. The adjustable blind holder has particular utility in connection with the hanging of Venetian blinds.

2. Description of the Prior Art

Adjustable blind holders are desirable for the fast, efficient, and aesthetically pleasing installation of Venetian blinds. In the past the typical method for installing blinds has used the separate installation of mounting brackets that would be attached to either the wall or the molding surrounding a window. This installation would lead to the difficulty of trying to ensure that the brackets, provided as separate units, were mounted in such a way that the blinds would be level. The adjustable blind holder provides a single unit that can be easily leveled and mounted, by a variety of means, to any surface surrounding a window. In addition, the means for mounting and the head rail of the blinds are commonly considered displeasing to the eye. Therefore the normal practice has been to install a decorative covering such as a window treatment to conceal these features. The solitary unit that is provided in The adjustable blind holder allows for the installation of a single device that performs the function of supporting the head rail for a blind while providing a decorative means for concealing these features. In addition, the adjustable blind holder could be easily adapted to be used as a mounting for multiple window coverings if a variety were desired on a single window.

Venetian blinds are one of the most commonly used forms of window coverings used. Their versatility and adaptability to various levels of lighting are the primary reason for this popularity. Retailers normally offer them in increments of one inch. The ability of the adjustable blind holder to be altered to a broad range of lengths would enable the installer of a blind to have a fast and easy method for hanging all sizes of blinds. While the utility of blinds is universally recognized, they are not considered attractive to the eye. Therefore it is a frequent practice to conceal all or part of the blinds with some form of decorative covering. The adjustable blind holder offers a single unit that can be designed to retain a variety of choices for window coverings while providing a decorative covering for the blind head rail through its exterior casing.

U.S. Pat. No. 4,699,196 to James E. Elliot discloses an adjustable Venetian blind. While this invention provides a design for a Venetian blind that can be adjusted to windows of varying width, it does not address the concealment of the means for supporting the blinds and its head rail. It also does not provide a system of support that can be installed as a single unit.

U.S. Pat. No. 2,837,152 to Nathan Edward Moore, Jr., is an alternate design for an adjustable Venetian blind. Like the Elliot '4,699,196 patent it poses the same difficulties related to the installation of separate mounting supports. It also does not provide a means for concealing these features.

U.S. Pat. No. 6,009,931 to James M. Peterson, is yet another design for Venetian blinds that can be adapted to windows of various sizes. Like the Elliot '196 and Moore '152 patents, the Peterson '931 patent does not remedy the problems created by the mounting of separate mounting devices. It does, however, disclose a new feature consisting of a decorative covering that can be attached directly on the head rail. Unlike the Peterson design, the current invention offers a device that can be used for any size or type of conventional window covering while providing decorative concealment that is separate from the blind itself. There are numerous circumstances where the versatility provided by a device separate from the blind head rail would be preferable in the decoration of a window blind.

U.S. Pat. No. 5,505,418 to Kevin J. Corcoran describes a means for installing a Venetian blind in combination with a roller window shade. While the support mechanism for blinds is similar to that provided in the preferred embodiment of the adjustable blind holder, it requires the installation of separate units. In addition the Corcoran '418 invention does not provide any means for concealing the head rail of the blinds or their supports.

U.S. Pat. No. 6,131,867 to Paul P. Mallek discloses a means for installing blinds without having to create holes in the walls or molding surrounding a window. Like the Corcoran '5,505,418 patent, the Mallek '867 patent discloses separate support mechanism for blinds. It also does not provide any means for concealing the head rail of the blinds or their supports.

U.S. Pat. No. Des. 337,469 to Sandra K. Young and Douglas J. Warner is a design patent for a decorative blind head rail. It does not, however, disclose an independent unit that provides the dual function of supporting all sizes of blinds, while providing a decorative concealment.

While the above-described devices fulfill their respective, particular objectives and requirements, the aforementioned patents do not describe an adjustable blind holder that allows for a single unit that can be easily installed and leveled as well as providing a decorative enhancement to the upper region of a window covering.

Therefore a need exists for a new and improved adjustable blind holder that can be used for a wide variety of window coverings of universal lengths, allows for the installation of a solitary unit, and incorporates a decorative enhancement to conceal the head rail of the window coverings. In this respect, the adjustable Blind holder according to the present invention substantially departs from the conventional concepts and designs of the prior art, and in doing so provides an apparatus primarily developed for the purpose of hanging window covers, particularly Venetian blinds.

SUMMARY OF THE INVENTION

In view of the foregoing disadvantages inherent in the known types of mounting devices for window blinds now present in the prior art, the present invention provides an improved adjustable blind holder, and overcomes the above-mentioned disadvantages and drawbacks of the prior art. As such, the general purpose of the present invention, which will be described subsequently in greater detail, is to provide a new and improved adjustable blind holder which has all of the advantages of the prior art mentioned heretofore and many novel features that result in an adjustable blind holder which is not anticipated, rendered obvious, suggested, or even implied by the prior art, either alone or in combination thereof.

To attain this, the present invention essentially comprises a top cover and a bottom cover that slides telescopically within the top cover. Each cover is provided with a device for mounting to the wall. The covers are connected and supported by a retractable member that is braced at one end to the top cover and at the other end to the bottom cover. At each end of the member are attached mounting devices for receiving the ends of a blind head rail.

There has been outlined, rather broadly, the more important features of the invention in order that the detailed description thereof that follows may be better understood and in order that the present contribution to the art may be better appreciated.

The invention may also include a set of holes in each cover, situated to enter towards a wall or molding and sized to receive screws appropriate for attachment to the wall or molding. In addition the covers may be formed to create a rectangular decorative covering meant to conceal the supporting devices for a blind head rail.

Another feature that would exist is a support attached to each cover. The supports would receive and be affixed to the retractable member. These supports would be attached to the upper interior walls of the covers so that they would be concealed from view.

Also attached to each cover would be a mounting brace. The mounting brace would be designed to receive the ends of a blind head rail. A preferred embodiment would have an open end where the head rail would enter. Near the edge of the brace is positioned a slot. A wall that slides into the slot will retain the end of a blind head rail.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable blind holder that has all of the advantages of the prior art and none of the disadvantages.

It is another object of the present invention to provide a new and improved adjustable blind holder that may be easily and efficiently manufactured and marketed.

An even further object of the present invention is to provide a new and improved adjustable blind holder that has a low cost of manufacture with regard to both materials and labor, and which accordingly is then susceptible of low prices of sale to the consuming public, thereby making such adjustable blind holders economically available to the buying public.

Still another object of the present invention is to provide a new adjustable blind holder that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
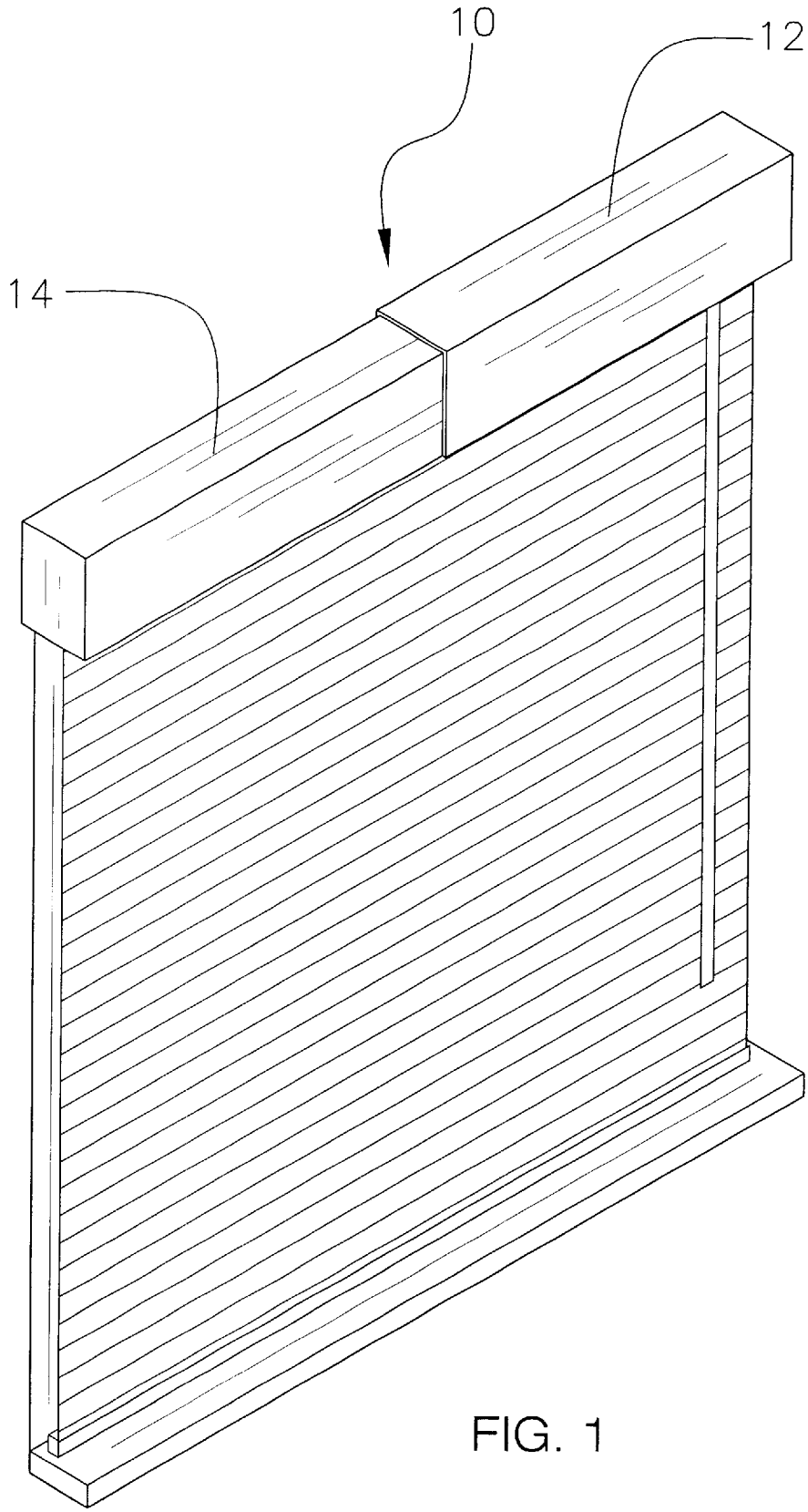
FIG. 1 is a front perspective view of the preferred embodiment of the adjustable blind holder of the present invention.

Referring now to the drawings, and particularly to FIGS. 1–4, a preferred embodiment of the adjustable blind holder of the present invention is shown and generally designated by the reference numeral 10.

FIG. 1, a front perspective view of a new and improved adjustable blind holder 10 of the present invention for hanging and decorating a Venetian blind is illustrated and will be described. Shown is a rectangular bottom cover 14 that slides telescopically within a rectangular top cover 12. Both covers could be made of a variety of lightweight materials that could be easily formed and mounted on a wall or window molding. Some likely choices would be plastic, aluminum or wood. The covers could also be made from a combination of these materials. Additional materials such as paper or cloth could be incorporated to create a desired decorative effect. It should also be noted that other shapes, tubular for instance, could be substituted for the rectangular shape of the covers. The exterior surface of the cover would offer versatility for decorative enhancement. Many different patterns and colors can be displayed on its surface either by molding the exterior surface or by applying a material such as paint or ink. shape of the covers. The exterior surface of the cover would offer versatility for decorative enhancement. Many different patterns and colors can be displayed on its surface either by molding the exterior surface or by applying a material such as paint or ink.

Figure 2:
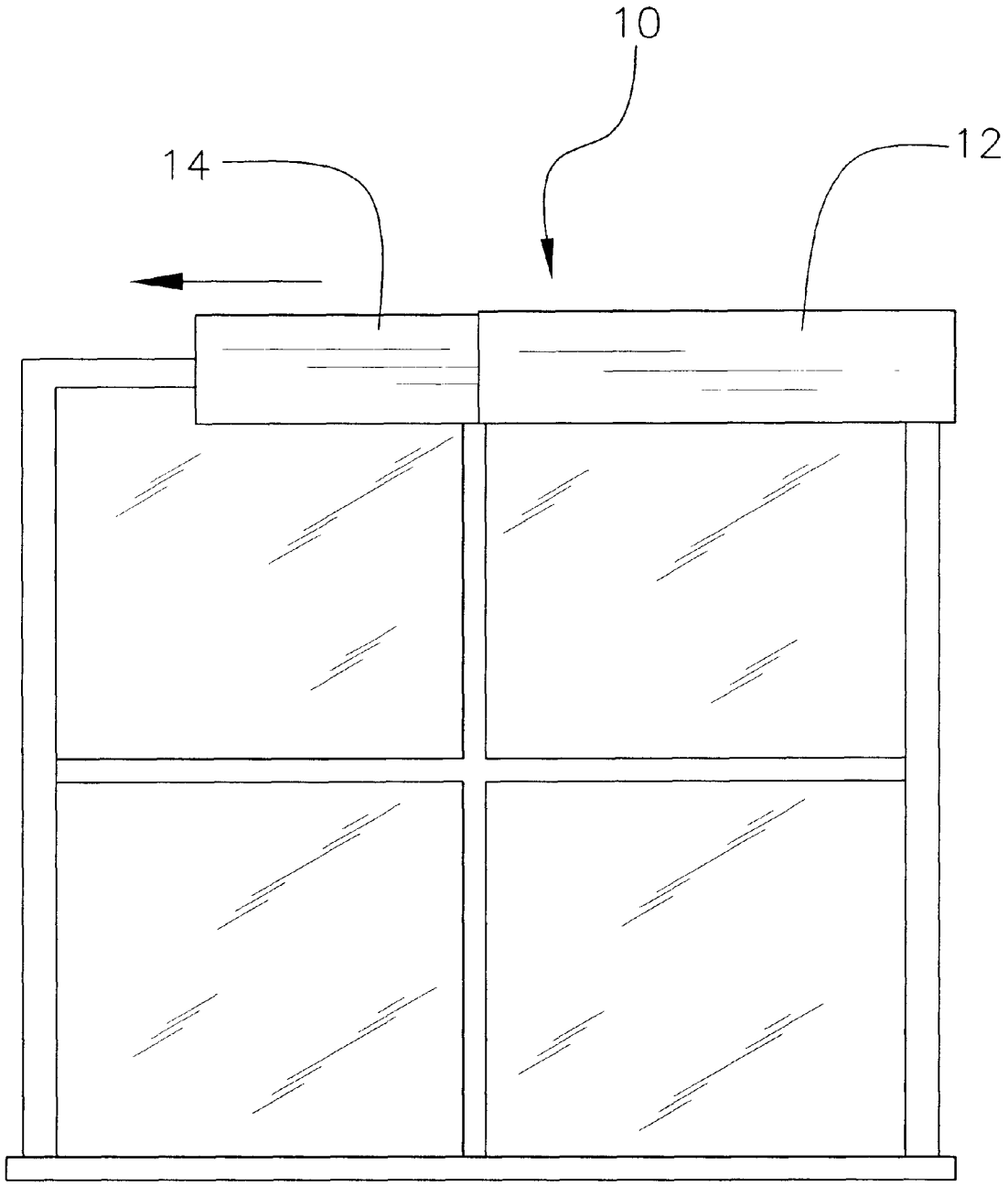
FIG. 2 is a front view of the adjustable blind holder in a retracted state of the present invention.

In FIG. 2, a front side view of an adjustable blind holder 10 is shown. In the figure are shown a bottom cover 14 that slides within a top cover 12. The embodiment displayed in this figure envisions a leftward sliding motion for the bottom cover out of the top cover. A variety of methods can accomplish this mechanism. The preferred embodiment consists of an interior retractable member that is mounted to both covers, however an example of an alternative method would include a lip connected to the top cover that would fold over and retain the bottom cover while forming a groove that would allow the bottom cover to slide within.

Figure 3:
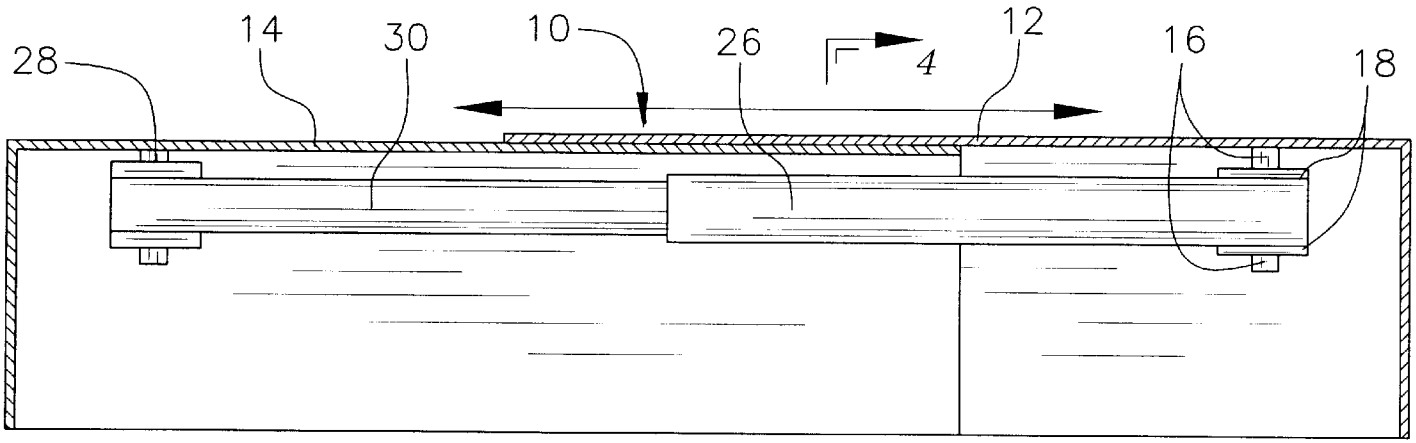
FIG. 3 is a rear side view of the adjustable blind holder of the present invention.

In FIG. 3, a rear side view of the adjustable blind holder 10 is illustrated. More particularly, the adjustable blind holder comprises a top cover 12. The preferred embodiment of the top cover 12 is shaped around a rectangular space. The top cover 12 will consist of four sides. Three of these sides span the surface of three adjacent lengthwise sides of the rectangular space. The third side is opposite of the first side and the second side is between the first and third sides. The fourth side spans the entire surface of the right end of the rectangular space. The left end side comprises an opening so that the bottom cover 14 can slide with in the top cover 12. The shape of the top cover 12 could be other then rectangular such as a tubular shape comprising an open portion running the length of the top cover 12 and an opening at one end. One method that could be used for mounting the top cover 12 would be an embodiment wherein the third side would comprise three circular holes. The holes would be placed so that they would represent the corners of a triangle. These holes would comprise a circumference whose diameter would allow a screw to pass through snuggly. An alternate embodiment would comprise several sets of holes such as those described above. These holes would be spaced apart along the same wall and would allow for mounting at several points so as to support a particularly long blind. This is but one example of many designs that could be conceived of for mounting the top cover 12 to a wall or molding. Other possible methods could use hooks or adhesives attached to the top cover 12.

In FIG. 3, a bottom cover 14 is shown on the adjustable blind holder. The preferred embodiment of the bottom cover 14 is shaped to cover a rectangular space. This rectangular space will be slightly smaller then the space covered by the top cover 12 so that the sides of the bottom cover 14 can slide within the sides of top cover 12. The bottom cover 14 will consist of four sides. Three of these sides span the surface of three lengthwise sides of the rectangular space. The third side is opposite of the first side. The second side is between the first and third side. The fourth side spans the left end of the rectangular space. The shape of the cover 14 could be other then rectangular such as a tubular shape with an open portion running the length of the cover and opening at one end. One method that could be used for mounting the top cover 14 would be an embodiment wherein the third side would comprise three circular holes. The holes would be placed so that they would represent the corners of a triangle. These holes would comprise a circumference whose diameter would allow a screw to pass through snuggly. An alternate embodiment would comprise several sets of holes such as those described above. These holes would be spaced apart along the same wall and would allow for mounting at several points so as to support a particularly long blind. This is but one example of many designs that could be conceived of for mounting the bottom cover 14 to a wall or molding. Other possible methods could use hooks or adhesives attached to the bottom cover 14.

Figure 4:
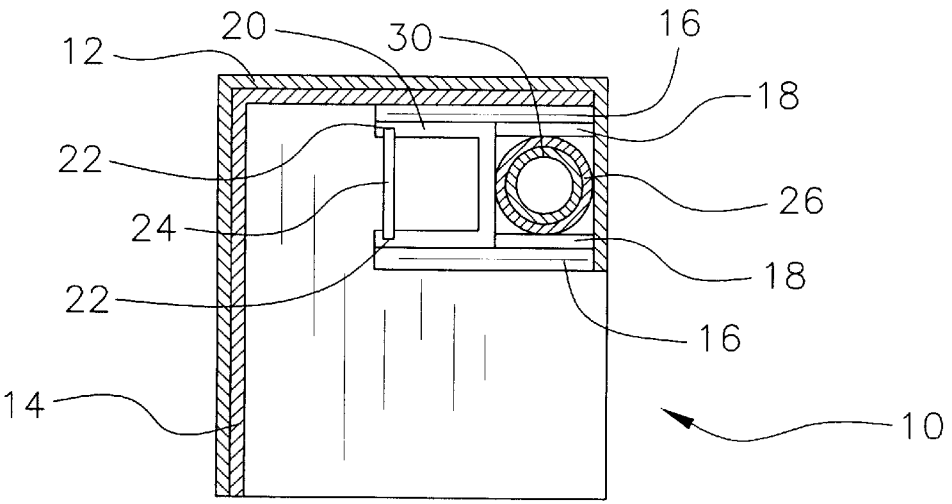
FIG. 4 is a left side view of the adjustable blind holder of the present invention.

In FIGS. 3 and 4, an open-ended support 16 is pictured on the interior of the top cover 12. One embodiment of the adjustable blind holder would comprise a pair of open-ended support walls that would constitute this support. These open-ended support walls would be rectangular in shape and would extend forward from the rear side of the top cover. The supports are positioned in a parallel fashion and mount bracing mechanisms for a retractable member and a mounting brace for a blind head rail. These mechanisms could be attached to the support walls by a bolt or adhesive for example. If multiple forms of window coverings are desired, then additional or alternate bracing mechanisms could be incorporated. An example of this would be a mount for a roller shade. An embodiment could exist where a variety of interchangeable supports could be attached to the support walls, depending upon need. In addition, the support system could be molded out of a material, such as plastic, into a single device that would perform all mounting needs. The open-ended support 16 can be made of a variety of materials such as plastic, wood, or metal.

In FIGS. 3 and 4, a rod support 18 is pictured connected to the abovementioned open-ended support 16. This rod support comprises two opposite sides and could be connected to the walls of the open-ended support 16 and the third side of the top cover 12. The sides of the rod support 18 would fit snuggly in the corners formed by the walls of the open-ended support 16 and the third side of the top cover. The space between the rod supports 18 is sized to snuggly receive the end of an outer rod 26 that will be explained later. The supporting of the rod could be achieved by a number of methods. One possibility would be a single piece that would surround the rod and fit snuggly between the support walls 16. The rod supports 18 can be made of a variety of materials such as plastic or metal. Rubber would be an excellent material to provide a frictional grip on the retractable member.

In FIG. 4, a blind mounting bracket 20 is pictured. Three adjacent sides of a cube that fits between the walls of the open-ended support 16 would form the bracket. The third side would be opposite the first side with the second side connecting between them. The two opposite sides would be connected to the opposing open-ended support walls 16. The third side would be connected to the ends of the rod support 18 and meeting flush with the outer rod 26 to be explained later. The blind mounting bracket 20 can be made of a variety of materials such as plastic or metal. On the interior sides of the parallel sides of the mounting bracket 20 and close to the ends of the sides are grooves 22 that run parallel to the ends. There are a variety of alternate means for retaining a blind head rail. The versatile design of the adjustable blind holder could incorporate any of these by substituting them for the above mounting bracket. In addition, bracing devices for many other window coverings could be mounted within the support walls.

In FIG. 4, a mounting bracket door 24 is pictured. The door would slide into the above-described grooves 22. The door will provide a forth side to the mounting bracket so as to create a space that will receive and retain the end of a standard sized Venetian blind. An attachable flap could replace this sliding door. The flap would be attached to the first side by a hinge and would attach to the third side by a snapping mechanism.

FIGS. 3 and 4, an outer rod 26 is pictured. The rod comprises a circular outer surface having a diameter that fits snuggly into the square space that is created by the third side of the top cover 12, the two sides of the rod support 18 and the second side of the mounting bracket 20. The outer rod 26 has a space pictured in FIG. 4 that runs its length and has a diameter that allows an inner rod 30 to slide within it. The outer rod 26 in combination with the inner rod 30 form a retractable member that acts as a sliding brace for the top and bottom covers. The outer rod 26 can be made of a variety of materials such as plastic or metal. In addition, the retractable member could be made in other shapes, such as rectangular or triangular. Other alternatives for the retractable mechanism exist. One example would be threading on the interior surface of the outer rod and the exterior surface of the inner rod that would enable the user to screw and unscrew the rods to alternate lengths.

In FIG. 3, an open-ended support 28 is pictured on the interior of the bottom cover 14. One embodiment of the adjustable blind holder would have a pair of open-ended support walls that would constitute this support. These open-ended support walls would be rectangular in shape and would extend forward from the rear side of the bottom cover 14. The supports are positioned in a parallel fashion and mount bracing mechanisms for a retractable member and a blind head rail. These mechanisms can be attached to the support walls by a bolt or adhesives for example. If multiple forms of window coverings are desired, then additional or alternate bracing mechanisms could be incorporated. An example of this would be a mount for a roller shade. An embodiment can be imagined where a variety of interchangeable supports could be attached to the support walls depending upon need. In addition the support system could be molded out of a material such as plastic into a single device that would perform all mounting needs. The open-ended support 28 can be made of a variety of materials such as plastic or metal.

A rod support is connected to the abovementioned open-ended supports 28. This rod support would comprise two sides connected to the walls of the open-ended support 28 and the third side of the bottom cover 14. The rod supports would fit snuggly in the corner formed by the open-ended support walls 28 and the third side of the bottom cover 14. The space between the rod supports is sized to snuggly receive the end of an inner rod 30 that will be explained later. The supports can be made of a variety of materials such as plastic or metal. The alternative options that are described above for the rod supports 18 would be available for these rod supports as well.

A blind mounting bracket is attached to the open-ended support 28. Three adjacent sides of a cube that fits between the open-ended support walls 28 would form the bracket. The third side would be opposite the first side with the second side connecting between them. The two opposite sides would be connected to the opposing open-ended support walls 16. The third side would be connected to the ends of the rod support 18 and meeting flush with the outer rod 26 to be explained later. The blind mounting bracket 20 can be made of a variety of materials such as plastic or metal. On the interior sides of the parallel sides of the mounting bracket 20 and close to the ends of the sides are grooves 22 that run parallel to the ends. A door would slide into the above-described grooves. The wall provided by this door will provide a forth side to the mounting bracket so as to create a space that will receive and retain the end of a standard sized Venetian blind. An attachable flap could replace this sliding door. There are a variety of alternate means for retaining a blind head rail. The versatile design of the adjustable blind holder could incorporate any of these by substituting them for the above mounting bracket. In addition, bracing devices for many other window coverings could be mounted within the support walls.

In FIG. 3, an inner rod 30 is pictured. The rod comprises a circular exterior surface having an outer diameter that fits snuggly into the square space that is created by the third side of the bottom cover 14, the two sides of a rod support and the second side of a mounting bracket. The outer diameter of inner rod 30 is slightly smaller then the diameter of the space inside the outer rod 26 so that the inner rod 30 slides telescopically within the outer rod 26. The inner rod could be adapted correspondingly to the various alternatives mentioned above for the outer rod 26.

While a preferred embodiment of the adjustable blind holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the plastic that has been described. And although the hanging of Venetian blinds has been described, there are slight variations, such as hooks attached to the adjustable blind holder that would make the invention appropriate for a wide variety of window coverings. In addition, the coverings that are suspended from the adjustable blind holder do not have to be limited to the concealment of a window.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable blind holder comprising:

a top cover comprising two ends, wherein one end comprises an opening, and wherein said top cover comprises an open portion that extends for the length of said top cover;

a bottom cover that slides telescopically within said top cover and comprises two ends wherein one end comprises an opening and said bottom cover comprises an open portion that extends the length of the cover;

a retractable member having two ends, one end of which is connected to said top cover, the other end of which is connected to said bottom cover;

a pair of mounting brackets having opposing sides and a back, one of which is connected to said top cover, the other connected to said bottom cover;

a plurality of grooves, wherein said opposing sides of said mounting brackets define a groove therein to comprise said grooves; and a pair of mounting bracket doors having opposing sides wherein said opposing sides are removably inserted into said grooves to secure a head rail once it has been inserted into said mounting brackets.

2. The adjustable blind holder of claim 1 further comprising a pair of open-ended supports, one of which is connected to said top cover and the other to said bottom cover, wherein each support is positioned to retain one of the two ends of said retractable member.

3. The adjustable blind holder of claim 1 wherein the retractable member comprises two hollow rods wherein the inner diameter of the first rod is slightly larger than the outer diameter of the second rod so that said second rod will slide telescopically within said first rod.

4. The adjustable blind holder of claim 1 wherein said pair of mounting brackets are U-shaped.

5. The adjustable blind holder of claim 1 wherein said top cover and bottom cover each comprise a plurality of holes therein.

6. The adjustable blind holder of claim 1 wherein said top cover and said bottom cover are four-sided housings having first, second, thirds and fourth sides, with said first side opposite said third side, said second side between said first and third side, and said fourth side at the end of said first, second and third sides, wherein said bottom cover is slightly smaller than said top cover so that the bottom cover slides telescopically within said top cover.

7. The adjustable blind holder of claim 6 further comprising a pair of open-ended supports, one of which is connected to said top cover and the other to said bottom cover, wherein each support is positioned to retain one of the two ends of said retractable member.

8. An adjustable blind holder comprising:

a top cover comprising two ends wherein one end comprises an opening, and said top cover comprises an open portion that extends for the length of said top cover;

a bottom cover that slides telescopically within said top cover and comprises two ends wherein one end comprises an opening and said bottom cover comprises an open portion that extends the length of the cover;

a retractable member having two ends comprising two hollow rods wherein the inner diameter of the first rod is slightly larger than the outer diameter of the second rod so that said second rod will slide telescopically within said first rod, one end of which is connected to the top cover, the other end of which is connected to the bottom cover;

a pair of mounting brackets having opposing ends and a back, one of which is connected to the top cover, the other connected to the bottom cover;

a plurality of grooves, wherein said opposing sides of said mounting brackets define a groove therein to comprise said grooves; and a pair of mounting bracket doors having opposing sides wherein said opposing sides are removably inserted into said grooves to secure a head rail once it has been inserted into said mounting brackets.

9. The adjustable blind holder of claim 8 wherein said pair of mounting brackets are U-shaped.

10. The adjustable blind holder of claim 8 wherein said top cover and bottom cover each comprise a plurality of holes therein.

11. The adjustable blind holder of claim 8 wherein said top cover and said bottom cover are four-sided housings having first, second, third, and fourth sides, with said first side opposite said third side, said second side between said first and third side, and said fourth side at the end of said first, second, and third sides, wherein said bottom cover is slightly smaller than said top cover so that said bottom cover slides telescopically within said top cover.

* * * * *